United States Patent [19]

Nam

[11] Patent Number: 4,810,007

[45] Date of Patent: Mar. 7, 1989

[54] BOOK STRUCTURE

[76] Inventor: Byung Y. Nam, 412-6, Duk Eun-Ri, Hwa Jun-Eup, Go Yang-kun, Kyung Ki-Do, Rep. of Korea

[21] Appl. No.: 78,664

[22] Filed: Jul. 28, 1987

[30] Foreign Application Priority Data

Aug. 21, 1986 [KR] Rep. of Korea ..... 86-12716[U]

[51] Int. Cl.[4] ..... B42D 1/00; B42D 5/02; B41L 43/00

[52] U.S. Cl. ..... 281/15 R; 281/38; 270/32

[58] Field of Search ..... 281/15 R, 19 R, 31, 281/34, 38; 283/17, 36, 38, 45, 46, 49, 50; 229/68 R; 270/5, 8, 32

[56] References Cited

U.S. PATENT DOCUMENTS

| | | | |
|---|---|---|---|
| 1,778,766 | 10/1930 | McMichael | 281/38 |
| 2,309,244 | 1/1943 | Fey | 281/38 |
| 2,889,638 | 6/1959 | Anderson | 281/15 R |
| 3,866,900 | 2/1975 | Kebba | 270/32 |
| 4,492,306 | 1/1985 | Cooper | 281/15 R |
| 4,538,833 | 9/1985 | Trikilis | 281/15 R |
| 4,618,166 | 10/1986 | Hsi | 281/15 R |

*Primary Examiner*—Paul A. Bell
*Assistant Examiner*—Paul M. Heyrana, Sr.
*Attorney, Agent, or Firm*—Oblon, Fisher, Spivak, McClelland & Maier

[57] ABSTRACT

A book structure adapted to all classes of books comprise the original text and the appendix provided with the appendix portion following the original text and the memo book extended from at least one side of each page of said appendix portion to obtain the extra space for writing down the memo item by the user, or editing the directory by the writer or the editor, thereby forming the composite book structure for attaining various objectives.

4 Claims, 4 Drawing Sheets

BOOK STRUCTURE

BACKGROUND OF THE INVENTION

This invention relates to all classes of books including the publications and the writing books, particularly to a book structure suitable for the editing and the binding of the books involved in test guides, reference books, novels and separate appendice.

For example, in using supplementary text materials that come with examination questions, the answers, and their explanations, this invention provides supplementary text book that allows an individual to promptly and accurately evaluate his/her own scholastic ability through him/her being enabled to unfold to open the answer sheets or the appendix after solving the questions.

But, conventional books having appendices are bound in single volumes with appendices, or appendices being separately bound so that when it is needed, it has to be pulled out and used.

Let us consider the practical usage of commentary, reference, annexed explanation, comparative table, chronicle, memorandum, bibliography, memo pages, work book pages in all classes of books used hitherto. Since all classes of books used hitherto are edited and bounded at writers' or editors' discretion and therefore utility from the user's view point is not fully reflected.

On basis of this fact, assume that a translated literature has foreign language text on left page and translated version on right. Explanation on difficult vocabularies or author's comments are normally placed in a predetermined lower region on each page, or in separately bound appendix. Therefore the user must be satisfied with passively understanding only the partial contents according to the writer's or editor's intent.

Regarding test guides that have collection of examination questions and explanation to the answers, or writing answers of such supplementary texts, answers to the questions are written either directly onto the question pages or on answer sheets attached at the back of the book.

Therefore, such way of writing answers has disadvantages in that one loses the chance to redo the questions once answered or that flipping pages to the back of the book to enter the answers is inconvenient. Also since such like a book has separated correct answer pages attached to the back of the book, it cause the inconvenience in checking the answers with the correct answers. To remedy such inconvenience, the users tend pull out the correct answer pages and the answer sheet pages to make a separate book. This happens to damage the book, and there is tendency that the users can only expect limited learning efficiency.

Especially, in all classes of books, contents of the explanation, the reference, the comparative table and the chronicle are written, according to the intent of the writer or the editor, only in the predetermined region, for example, the lower portion or the right and left space of each page. Since such region is limited, it is difficult to make the readers perceive sufficient explanation effect.

SUMMARY OF THE INVENTION

The invention, not only tries to solve the said disadvantages, but also is devised to propose a new structure for books overcoming the tendency of conventional books editing that demands only the passive acceptance attitude of the user according to the writer or the editor.

Accordingly, the objective of this invention is to provide the supplementary text, such as the test guide that when it is used as a supplementary text, the reader or the user solves the examination questions by himself filling the answers on separate answer sheets, and when checking his answers with the correct answers, the user can fold question up or aside and check his/her answers with the correct answers along with explanation to the answer simultaneously.

Also, the other objective of this invention is to provide a new book structure having the extra space for enhancing the reading efficiency or maximizing the learning efficiency, in which a book structure adapted to all classes of books comprises the original text and the appendix provided with the appendix portion including a plurality of pages following the original text and a memo book including a plurality of pages extended from at least one side of each page of said appendix portion, as shown in FIG. 6, to obtain the predetermined space having the practical use as the generic concept of the note book and of the memo book, such as a commentary, a reference, an additional explanation, a comparative table, a chronicle, a memorandum, a bibliographpy column and a remark, whereby the user can simultaneously read the memo items along with the contents of its associated original text or can write down his/her appreciative criticism or memo, and further, his/her own thoughts different from the intents of the writer or the editor and the reference items on the bibliography in the appendix.

Therefore this invention makes the reader or the user to have the feeling of participation in the binding of the book, and the invention seeks for the learning efficiency of the education. As a whole, this invention prevents the damage of the original text and makes the checking to be easier, thereby allowing saving of the time. Besides, this invention has advantages in that the reader can evaluate his/her own score accurately, and he/she can experience new feeling when reading his/her own comments later.

BRIEF DESCRIPTION OF THE DRAWINGS

The above objectives and advantages of this invention can be seen by referring to the detail description in connection with the accompanying drawings: in which.

DETAILED DESCRIPTION OF THE PREFERRED EMBODIMENTS

Figure 1:
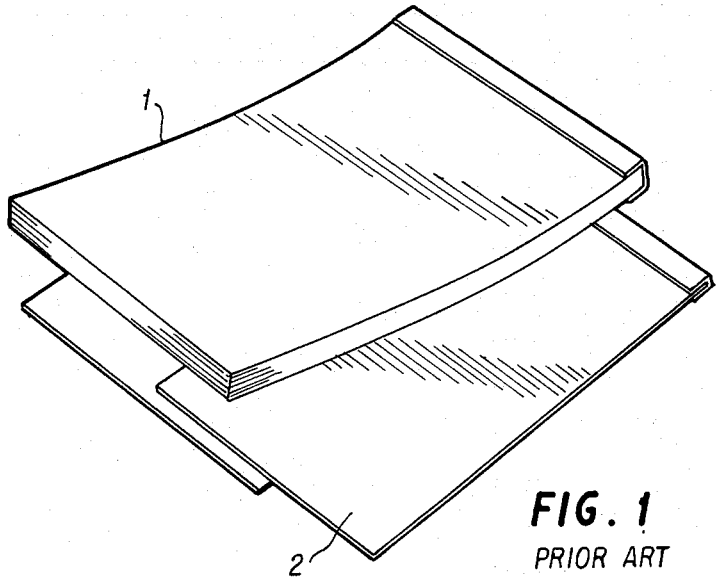
FIG. 1 PRIOR ART
FIG. 1 is a view showing separated book and it's appendix that are bound by the conventional way.
Figure 2:
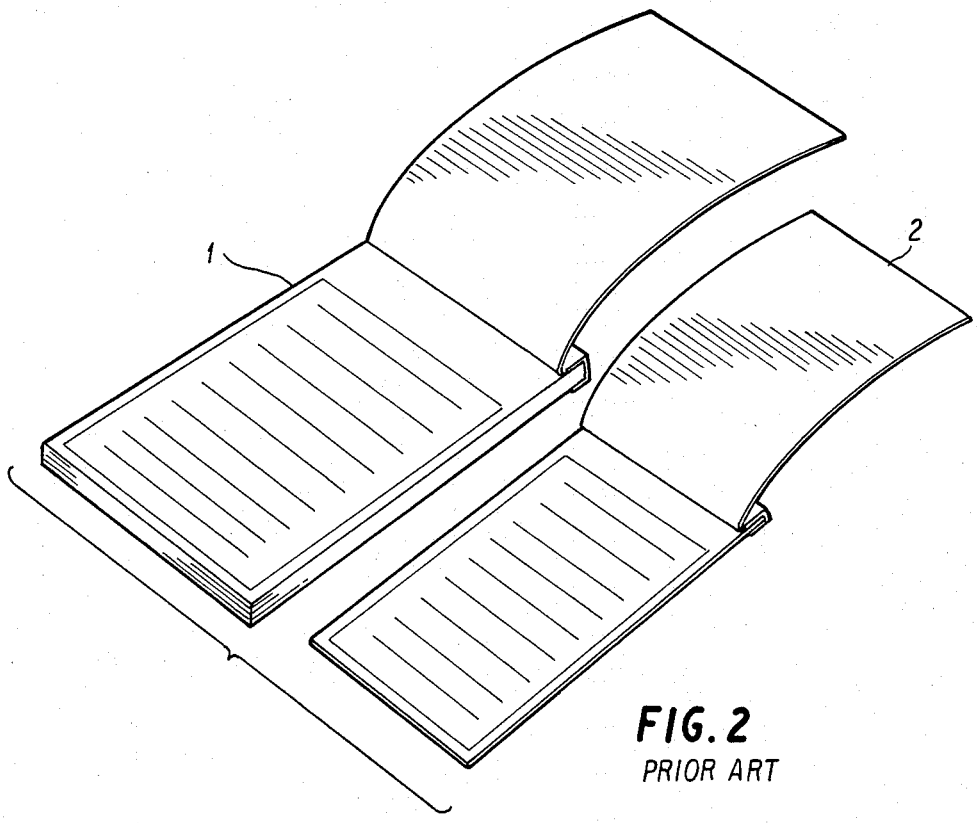
FIG. 2 PRIOR ART
FIG. 2 is a view showing the books in FIG. 1 in use.

FIG. 1 and FIG. 2 are views with respect to books of the prior art, in which for example, test guide 1 and explanations to the answers and/or answer sheets 2 are illustrated, but such like test guide 1 and explanations of the answers and/or answer sheets 2 may be considered as a novel and a separated appendix, respectively.

Test guide 1 as a collection of examination questions is a regular book bound in a single volume and answer explanation 2 is corresponding to a separated appendix. When they are sold, the explanation 2 is inserted in the test guide 1. Such like a separated book is used as shown in FIG. 2 and it seems to be convenient, but in fact, the increase of the learning effect may not be expected and it can be lost easily. Also only the learning effect according to the intent of the editor or the writer can be expected.

Figure 3:
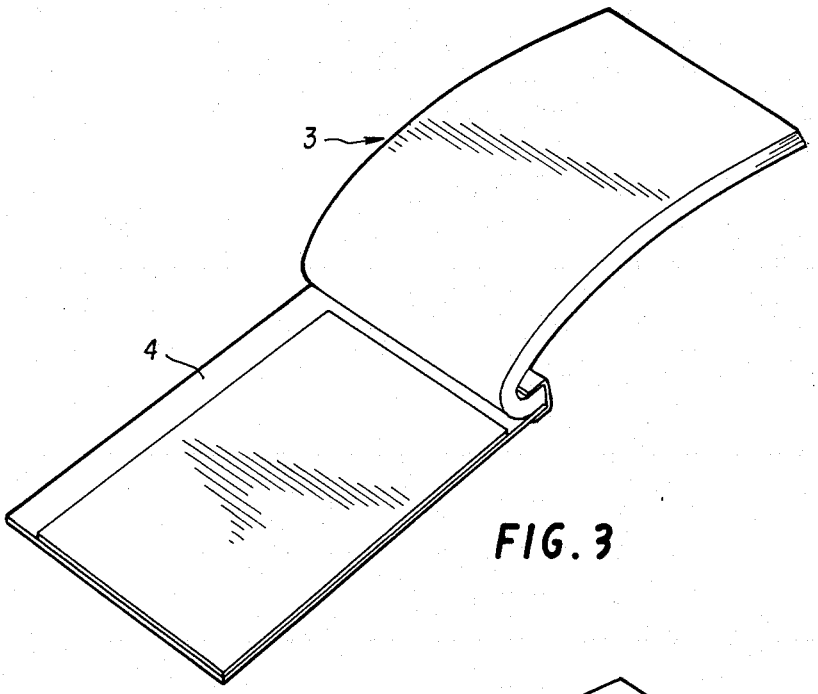
FIG. 3 is a perspective view of the book having a book structure according to this invention.
Figure 4:
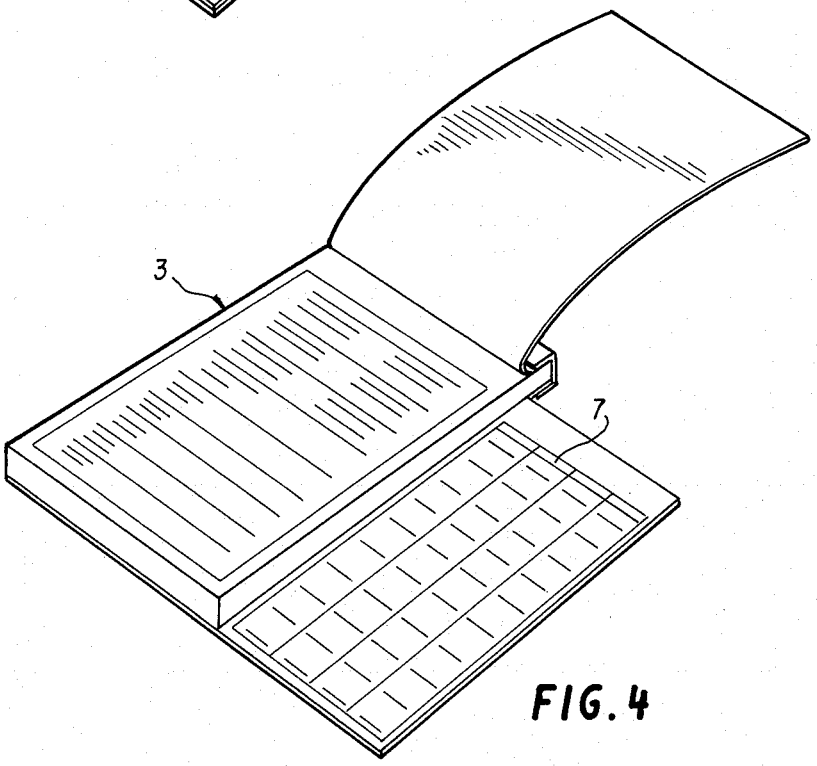
FIG. 4 is a view showing the original text and unfolded memo book or answer sheets according to one usage of this invention.
Figure 5:
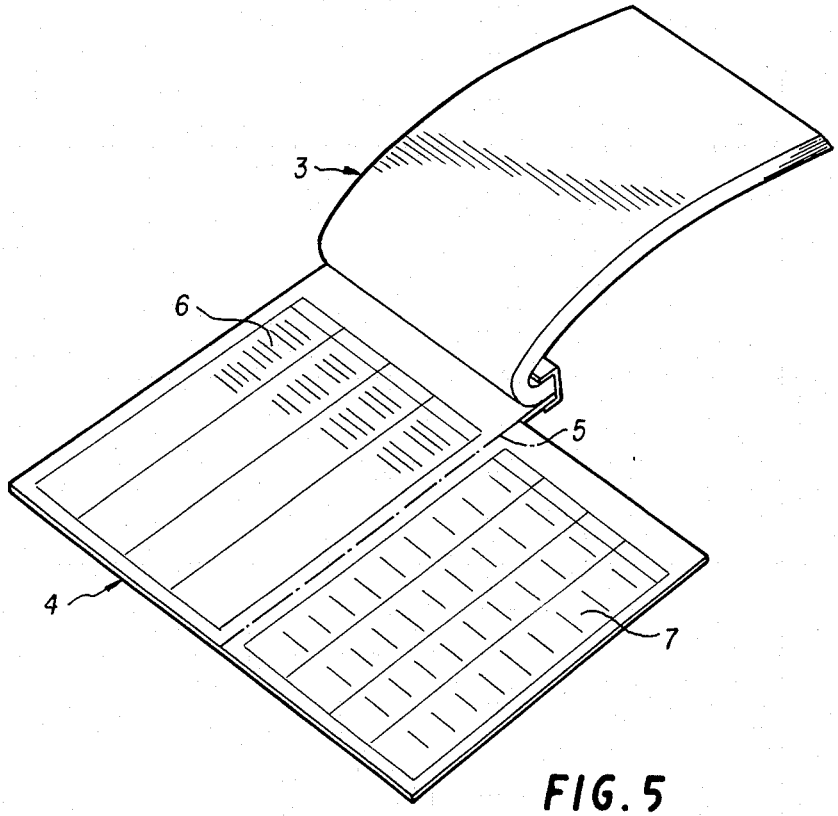
FIG. 5 is a view showing the unfolded memo portion according to the other usage of this invention.

This invention is illustrated in the form of a single volume as shown in FIG. 3, FIG. 4, and FIG. 5. Book 3 constructed according to this invention comprises a stack of single sheets and supplemental page is edited to have a separate 4 bounded integrally to it's end portion. This supplemental page 4 has right and left pages, in which one of the right and left pages is aligned with the stack and the other can be folded and/or scored by defining the folding line or perforate scoring line 5 as a boundary line. For example, left page may be designed an appendix for the explanation to answers 6 and right page may be answer sheets or memo column portion.

On the other hand, book 3 is commonly referred to as all classes of books and supplemental page 4 is referred to as the note book and the memo book used practically as the commentary, the reference, the additional explanation, the comparative table, the chronicle, and the bibliography, etc.

Further, supplemental page 4 of this invention must be understood as the portion which can be suitably used for the convenience of the user according to its purpose of usage and its practical use, and particularly, it must be considered as a separated volume bound in a single book.

On other words, this supplemental page 4 lets the user to write, on appendix portion 6, contents that are less frequently used by the user, and, in memo portion 7, contents that are more frequently used or simultaneously used along with the original text by the user.

In connection with the supplementary text, appendix portion 6 of supplemental page 4 may be designed as the collection of the correct answers to the examination questions or the collection of explanations to the answers, and memo portion 7 may be designed to be filled with the answers. Also if such a book is a translated literature with a supplemental page according to his inventions, the memorandum or the bibliography can be edited in appendix portion 6, and memo portion 7 is designed to include the vocabularies or important points or the commentary for the difficult content of the novel Particularly, memo portion 7 may carry on the function of appendix portion 6 to use as the reference column.

Therefore this invention leads the user or the reader to participate in the edition of books, thereby raising the learning effect of the student and giving the participating feeling in the editing to the reader. Also this invention seeks for the convenience of the user and maximizes the efficiency of his/her time.

Figure 6:
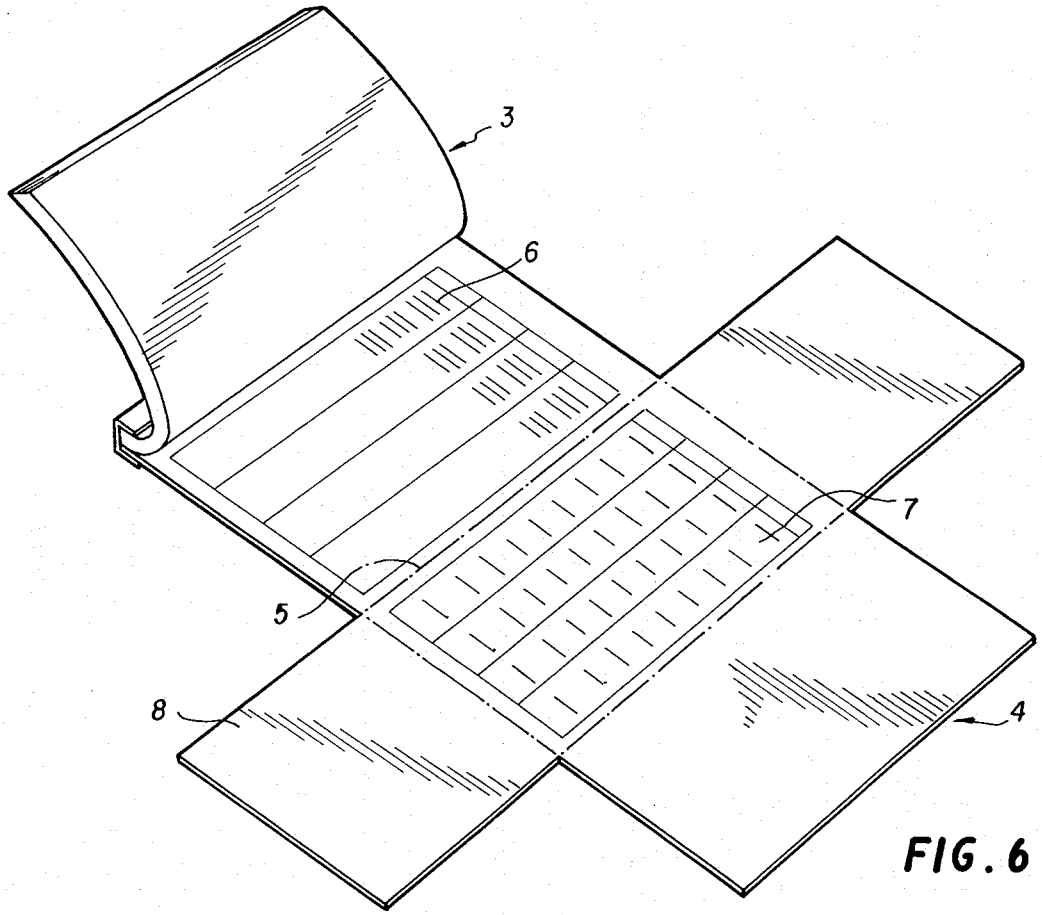
FIG. 6 is a view showing the other embodiment of this invention.

FIG. 6 relates to the other embodiment according to the principle of this invention. As shown in the drawing, supplemental portion 4 comprises appendix portion 6 and memo portion 7, in which these appendix portion 6 and memo portion 7 have the extension portions 8 as separate pages extended therefore forming the second scoring line between each of said portions, whereby the extension portion 8 may be folded by one column or a mutiple of columns.

Also this embodiment may allow appendix portion 6 to be designed to be filled with the contents that are less frequently used by the writer, the editor, or the reader, and get memo portion 7 along with the extension portion 8 are designed to enter the contents that have a high frequency of the use therein. The extension portion 8 may function as the note book or the memo book.

Thus, the appendix of such book may have the page number or the planning number and column number in other words, a directory, on each of its sheets to maximize the practical use by the reader according to the intent of the writer or editor or allow the participation of readers in designing and editing of the book, thereby giving the voluntariness to memo portion 7 and making the writer or editor attain their predetermined objectives.

On the other hand, this invention may be used as the note book for the student as well as the memo book for the general public.

In the light of these point, this book structue may be considered as the composite structure. Also if necessary, memo portion 7 may be cut or torn away along the scoring line without damaging the original form of the book. Accordingly, this invention comprises the book structure which can be made by a composite structure provided with a book and note book that can be designed by the reader.

I claim:

1. A book structure comprising:

a plurality of bound pages comprising single sheets stacked one upon the other;

at least one supplemental page bound to the back of the stack of single sheets, each said supplemental page comprising:

(a) an appendix portion aligned with said stack of single sheets, (b) a memo portion extending from at least one unbound edge of said appendix portion, each said memo portion being extendable out of alignment with said stack of single sheets, and (c) scoring lines separating said appendix portion from each said memo portion, whereby each said memo portion may be folded over at a respective one of said scoring lines to be in alignment with said stack of single sheets.

2. The book structure of claim 1, including an extension portion extending from at least one edge of each said memo portion, each said extension portion being separated from a respective said memo portion by a second scoring line, whereby each of said extension portions may be folded over at a respective one of said second scoring lines to be in alignment with said stack of single sheets.

3. The book structure of claim 2, including one of said extension portions extending from at least two edges of each said memo portion.

4. The book structure of claim 1 wherein said scoring lines comprise small perforations, whereby said memo portion may be separated from said appendix portion.

* * * * *